US006931986B1

(12) United States Patent
Liu et al.

(10) Patent No.: US 6,931,986 B1
(45) Date of Patent: Aug. 23, 2005

(54) STRAPPING MACHINE AUTOMATICALLY ADJUSTING THE STRAP TENSION

(75) Inventors: Chin-Chang Liu, Taichung (TW); Chi-Jan Su, Taipei (TW)

(73) Assignees: Tekpak Corporation, Taichung (TW); Transpak Equipment Corporation, Taipei (TW)

( * ) Notice: Subject to any disclaimer, the term of this patent is extended or adjusted under 35 U.S.C. 154(b) by 0 days.

(21) Appl. No.: 10/971,102

(22) Filed: Oct. 25, 2004

(30) Foreign Application Priority Data

Jul. 20, 2004 (TW) ..... 93211464 U

(51) Int. Cl.[7] ..... B65B 13/22

(52) U.S. Cl. ..... 100/4; 100/32; 53/64; 53/589; 242/563.2

(58) Field of Search ..... 100/4, 26, 29, 100/32; 226/42, 43; 242/563.2, 564.4; 53/64, 53/589; 33/732, 734, 747

(56) References Cited

U.S. PATENT DOCUMENTS 4,097,726 A * 6/1978 Satoh et al. ..... 377/18
4,581,514 A * 4/1986 Inoue ..... 219/69.12
5,809,873 A * 9/1998 Chak et al. ..... 100/4
6,003,438 A * 12/1999 Schwede ..... 100/4
6,286,780 B1 * 9/2001 Yuyama et al. ..... 242/563
6,363,690 B1 * 4/2002 Lay et al. ..... 53/410

* cited by examiner

*Primary Examiner*—Derris H. Banks
*Assistant Examiner*—Jimmy Nguyen
(74) *Attorney, Agent, or Firm*—Troxell Law Office, PLLC

(57) ABSTRACT

A strapping machine automatically adjusting the strap tension includes a sensor to interact with two sense members fixed on a subordinate wheel of an advance and retreat device, which consists of a main wheel and the subordinate wheel. The sensor and the sense members sense the advanced and the retreated rounds of the subordinate wheel when a strap is moved through a gap between the main wheel and the subordinate wheel. Then sensor sends a signal of the length practically needed to bind the strap around an object to a signal processor, which calculates and records and sends the difference cardinality to a controller. Then the controller controls operation and stopping of the motor of a strap tension device according to the signal so that the strap machine can automatically adjust the strap tension for binding the strap.

2 Claims, 5 Drawing Sheets

STRAPPING MACHINE AUTOMATICALLY ADJUSTING THE STRAP TENSION

BACKGROUND OF THE INVENTION

1. Field of the Invention

This invention relates to a strapping machine, particularly to one possible to automatically adjust the strap tension for various sizes of an object to be strapped.

2. Description of the Prior Art

A conventional strapping machine shown in FIG. 1, includes an arch frame 11, an supersonic sensor 12 on the arch frame 11, and a detecting table 13 for placing an object 14 to be strapped with a height (H), a signal processor receiving signals from the sensor 12, and a controller receiving a signal from the signal processor so as to give a proper strap tension to the strap 15 for strapping the object with various heights (H).

The conventional strapping machine 10 can adjust the strap tension for a strap 15 for binding an object with a different height (H) by means of the supersonic sensor 12, with the height functioning as a critical condition for adjusting. However, an object to be strapped may have different width to change the volume of an object to be strapped with the same height, but the supersonic sensor only detects the height, but not the width so the real volume may not be detected out, impossible to accurately control the strap tension for the object to be strapped. Therefore, the strap 15 may have too loose or too tight tension for the object.

SUMMARY OF THE INVENTION

This invention has been devised to offer a strapping machine automatically adjusting the strap tension, which has a guide base guiding a strap to pass a gap between a main wheel and a subordinate wheel of an advance and retreat device. The main wheel is driven by a power motor to advance or to retreat the strap. The subordinate wheel is provided with two symmetrical sense members fixed flush with the outer circumferential surface of the subordinate wheel, and a sensor is positioned beside the subordinate wheel to touch and interact with the sense members during rotation of the subordinate wheel.

Then the sensor senses the advanced and retreated rounds of the subordinate wheel and sends a signal to a signal processor, which automatically calculates the difference cardinality by the advanced rotation rounds minus the retreated rotating rounds, and sends the difference cardinality to a strap tension device for operation or stopping of the motor of the strap tension device, which may increase or reduce the strap tension. If the cardinality value is larger, it means the object is larger, and if the cardinality value is smaller, it means the object is smaller. So the controller can control the current to the motor for raising or lowering it according to the size of the object being strapped so the motor can be stopped with a delayed time or earlier according to the strap tension decided by the strap tension device to cope with the size of an object being strapped.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
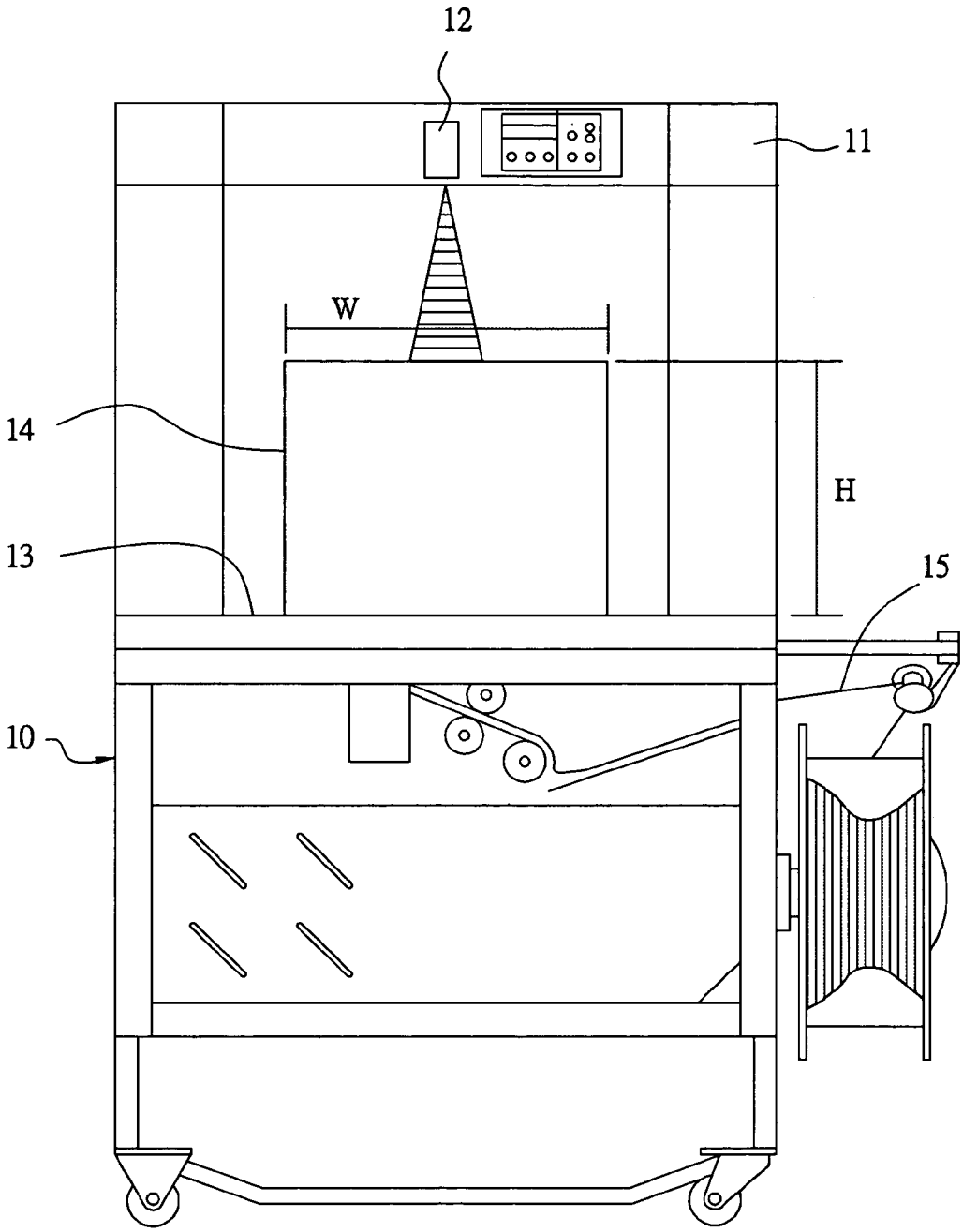
FIG. 1 is a side view of a conventional strap machine.
Figure 2:
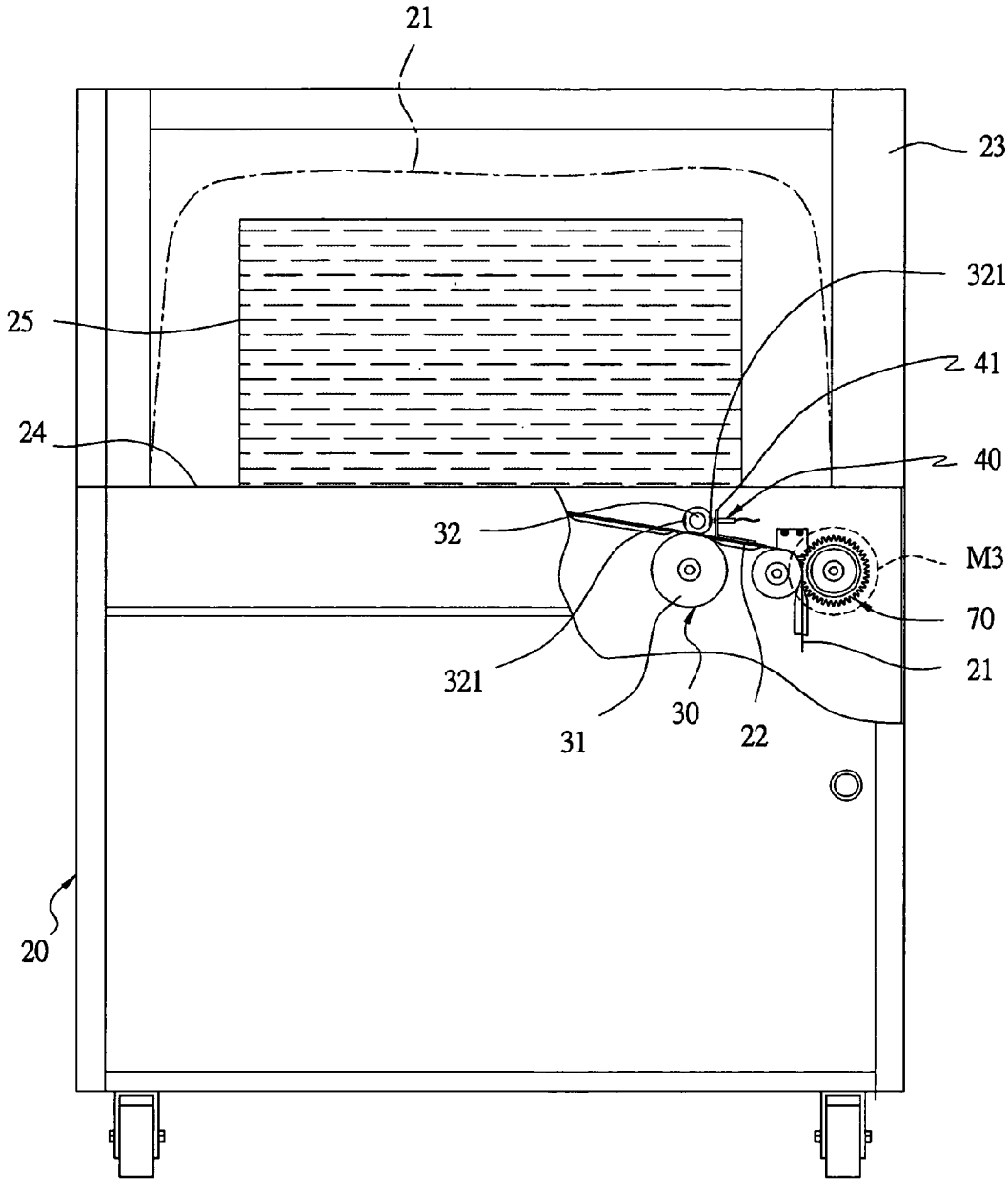
FIG. 2 is a side view of a strapping machine automatically adjusting the strap tension in the present invention.
Figure 3:
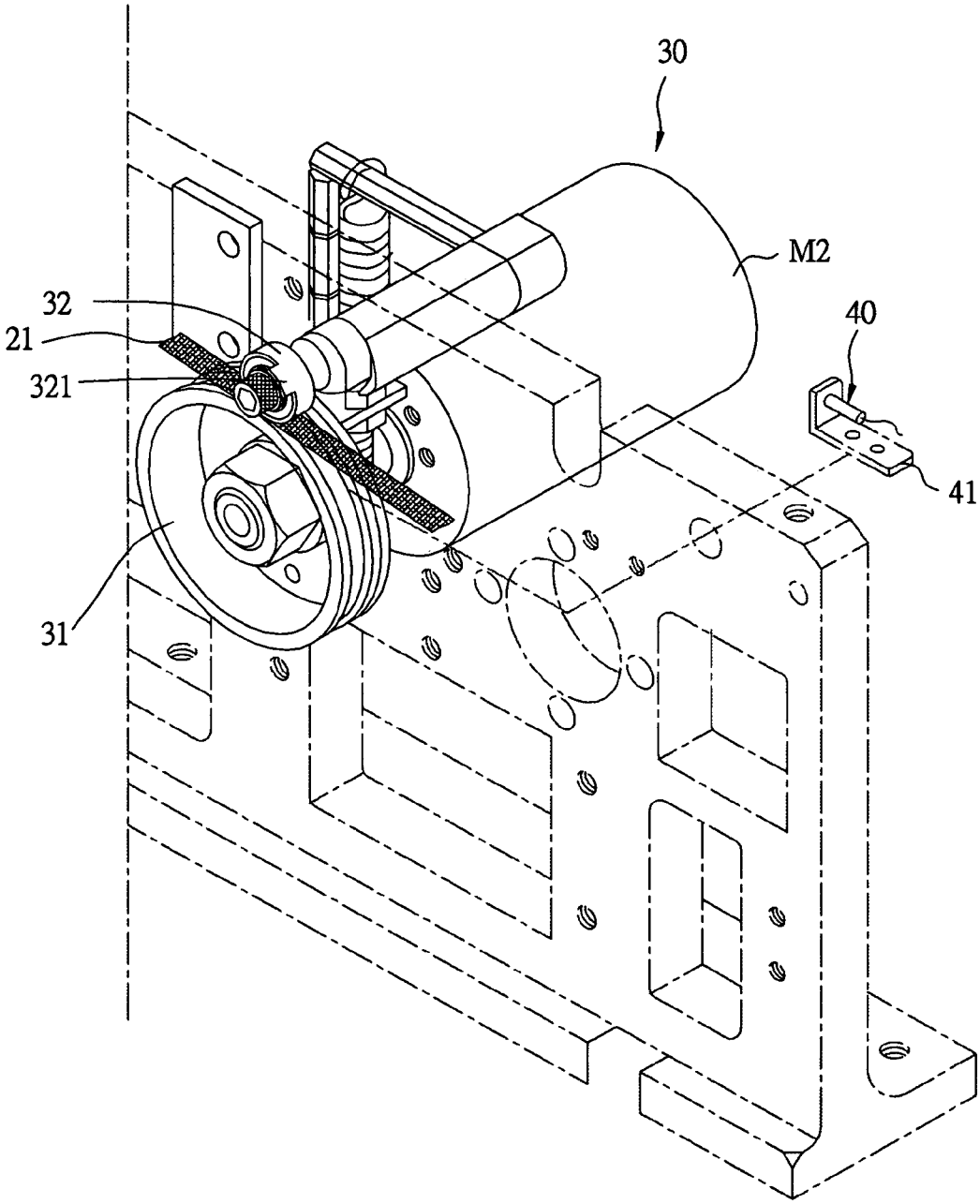
FIG. 3 is a partial perspective view of the strapping machine in the present invention.
Figure 4:
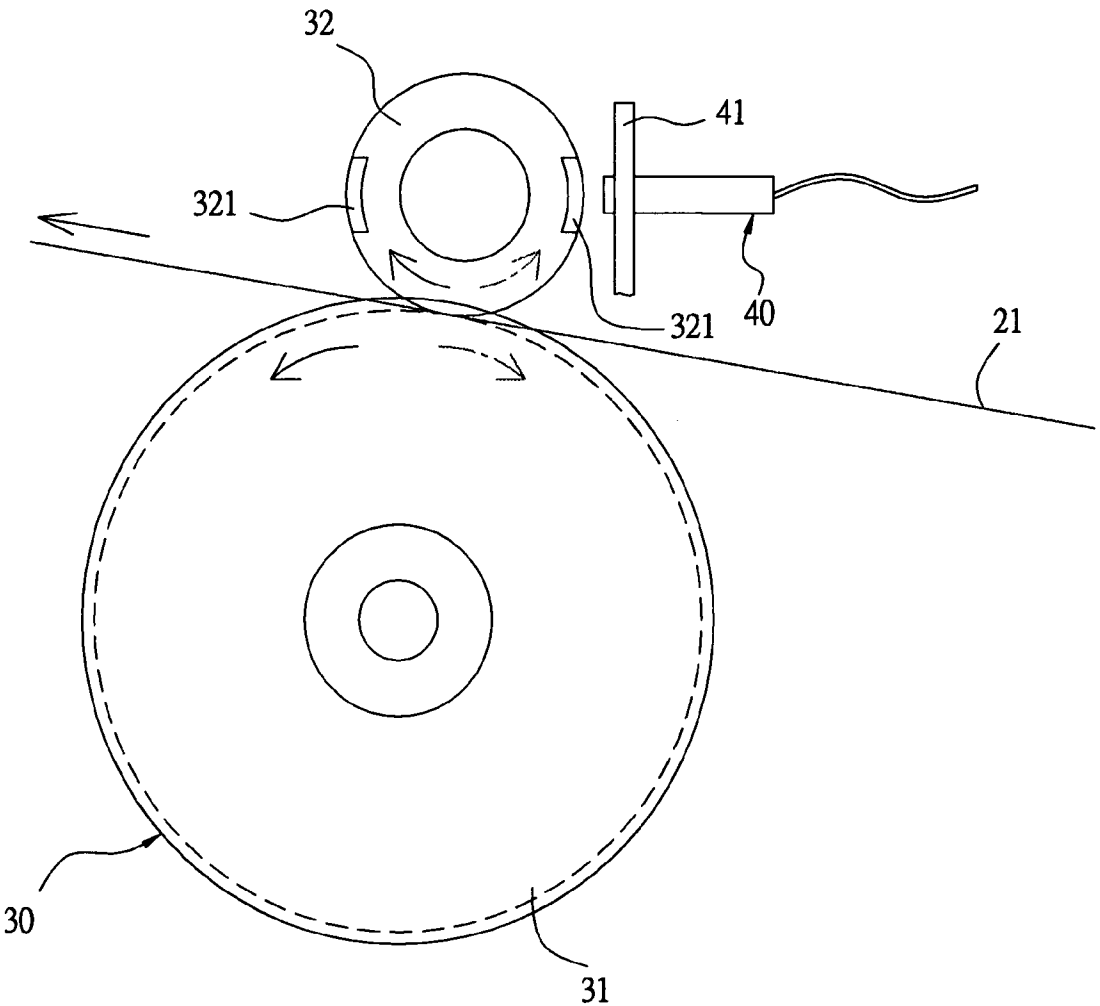
FIG. 4 is an partial side view of an advance and retreat device in the present invention; and, FIG. 5 is a flow chart of the automatic adjusting process for the strap tension in the present invention.

A preferred embodiment of a strapping machine 20 automatically adjusting the strap tension in the present invention, as shown in FIG. 1, includes a guide base 22 for a strap 21, an advance and retreat device 30, and a sensor 4.

The advance and retreat device 30 consists of a main wheel 31 and a subordinate wheel 32 positioned to abut to each other with a gap for the strap 21 to pass therethrough, The main wheel 31 is driven by a power motor (M2), rotating the subordinate wheel 32 at the same time for sending the strap 21 into an arch frame 23 of the strap machine 20 for binding the strap 21 around an object 25 to be strapped on a worktable 24.

Two sense members 321 are provided symmetrically at two opposite points on an outer surface of the subordinate wheel 32, positioned flush with the outer circumferential surface.

Figure 5:
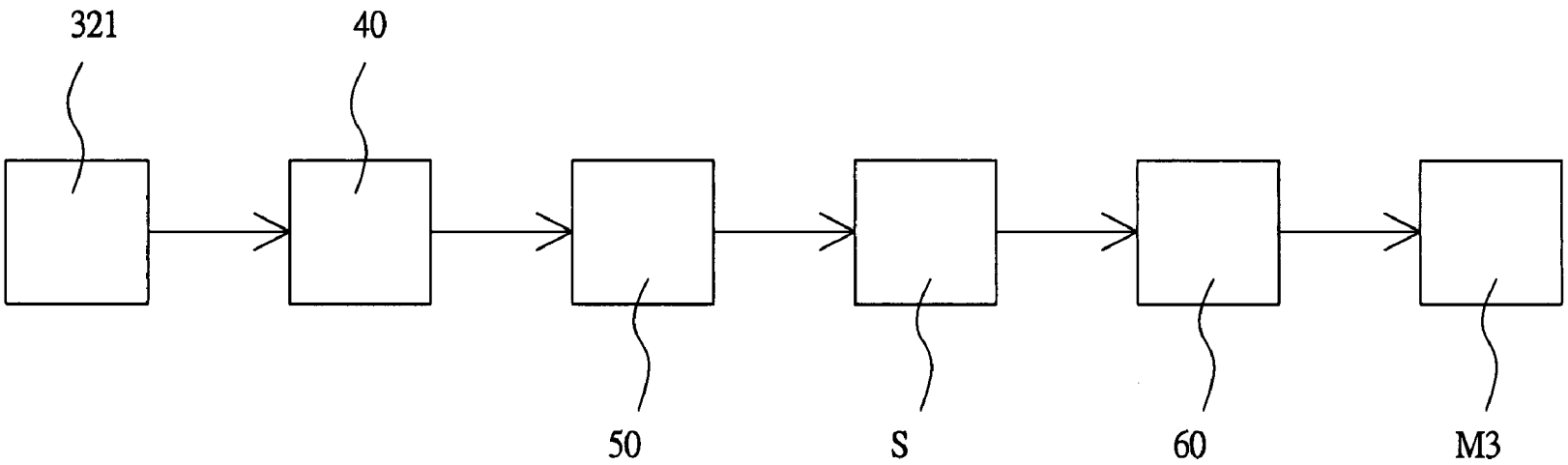

The sensor 40 is like a switch, fixed on a base plate 41, which is locked on a guide base 22 beside the advance and retreat device 30, so the sensor 40 is located just beside the subordinate wheel 32 to touch and interacts with the sense members 321 on the subordinate wheel 32 during its rotation. Then, as shown in FIG. 5, the sensor 40 sends a sensed signal to a signal processor 50, when senses the advanced rounds and the retreated rounds of the subordinate wheel 32 during strapping process. Then the signal processor 50 calculates the difference cardinality (S) of the length of the advanced one and the retreated one. The difference cardinality (S) is the length of the strap 21 practically used for strapping the object. Then the signal processor 50 records and at once sends this difference cardinality (S) to a controller 60 for controlling a motor (M3) of the strap tension device 70 to operate or stop.

Next, the operation of the strap machine is to be described. When the strap machine 20 is started to operate, the power motor (M2) drives the main wheel 31, which then rotates the subordinate wheel 32. Then the strap 21 is guided into the arch frame 23, with the strap 21 is advanced to a certain proper position, and the motor (M2) at once stops. The two sense members 321 contact with the sensor 40 during rotation of the subordinate wheel 32, so the sensor 40 can interact and sends the signal of the advanced and the retreated rounds of the subordinate wheel 32 to the signal processor 50, which then records the signal. During binding the object to be strapped, the strap machine 20 electrifies the power motor (M2) of the advance and retreat device 30 and the motor (M3) of the strap tension device 70 to pull back the strap 21 for binding the strap 21 around the object 25. The sensor 40 sends a signal of the advanced and the retreated rounds of the subordinate wheel 32 to the signal processor 50 for recording. Meanwhile the signal processor 50 converts the signal of the advanced and the retreated rounds into the advanced and the retreated length of the strap 21, and calculates out the difference cardinality (S) automatically by deducting the retreated rounds from the advanced rounds. Then this signal of the difference cardinality (S) is recorded and sent at once to the controller 60, which then makes proper decisions according to this value, controlling the operation or stopping of the motor (M3) and subsequently automatically adjusting the strap tension for an object 25 being strapped. In other words, the larger the difference cardinality, the larger the object 25. Then the strap 21 to be used is longer. Then when the controller 60 gets this signal, it controls the motor (M3) to raise the current to augment pulling force for increasing the length of the strap 21 to be retreated so the strap tension may be raised. On the contrary, if the value (S) is smaller, the object 25 is also smaller, needing a shorter strap 21. Then the controller 60 reduces the current for the motor (M3) for diminishing the retreated length of the strap 21, and subsequently the strap tension is lowered accordingly.

Lastly, it is worth to mention that this strap machine uses the subordinate wheel 32 for deciding the practical length of the strap 21 to be needed for an object 25 with its rotating rounds of advancing and retreating of the subordinate wheel 32. Therefore, the object can be strapped properly according to the real size of the object; the larger is an object 25, the higher the strap tension is automatically adjusted; the smaller is an object 25, the lower the strap tension is automatically adjusted. So the object 25 may not be deformed or damaged if the strap machine in the invention straps it.

While the preferred embodiment of a strap machine has been described above, it will be recognized and understood that various modification may be made therein and the appended claims are intended to cover all such modifications that may fall within the spirit and scope of the invention.

What is claimed is:

1. A strap machine automatically adjusting the strap tension comprising:

A guide base for guiding a strap:

An advance and retreat device consisting of a main wheel and a subordinate wheel positioned to abut to said main wheel with a gap, the strap passing through said gap clamped by said main and said subordinate wheel during operation of said main wheel, said main wheel driven by a power motor, said strap advanced and retreated by said main wheel and said subordinate wheel and guided to move in an arch frame of said strap machine to be strapped around an object placed on a worktable: and, Characterized by said subordinate wheel provided with two symmetrical sense members fixed flush with an outer circumferential surface of said subordinate wheel, a sensor positioned beside said subordinate wheel to touch and interact to said two sense members during rotation of said subordinate wheel, said sensor sensing advanced rounds and retreated rounds of said subordinate wheel, said sensor sending a signal of the advanced and the retreated rounds to a signal processor, said signal processor automatically calculating and recording the difference cardinality of the advanced and the retreated rounds, said processor sending the difference cardinality to a controller, said controller possible to control operation and stoppage of a motor of a strap tension device, said controller raising the current to said motor for augmenting pull force to delay the stopping of said motor so as to heighten the strap tension for an object being strapped in case of said difference cardinality becoming larger, said controller lowering the current to said motor to reduce the pulling force to stop said motor earlier and lowering the strap tension for an object in case of said difference cardinality becoming smaller.

2. The strapping machine automatically adjusting the strap tension as claimed in claim 1, wherein said sensor is like a switch, fixed on a base plate, and said base plate is locked in a guide base positioned beside said advance and retreat device so that said sensor is located abutting to said subordinate wheel.

* * * * *